US010336511B2

(12) United States Patent
Stolle

(10) Patent No.: US 10,336,511 B2
(45) Date of Patent: Jul. 2, 2019

(54) DOSING CAP FOR A DOSING BOTTLE

(71) Applicant: SHB GMBH, Crailsheim (DE)

(72) Inventor: Hans-Werner Stolle, Crailsheim (DE)

(73) Assignee: SHB GmbH, Crailsheim (DE)

( * ) Notice: Subject to any disclaimer, the term of this patent is extended or adjusted under 35 U.S.C. 154(b) by 752 days.

(21) Appl. No.: 14/975,953

(22) Filed: Dec. 21, 2015

(65) Prior Publication Data

US 2016/0176593 A1 Jun. 23, 2016

(30) Foreign Application Priority Data

Dec. 19, 2014 (EP) ..... 14199368

(51) Int. Cl.

| | |
|---|---|
| ***B65D 47/00*** | (2006.01) |
| ***B65D 47/08*** | (2006.01) |
| ***B65D 47/06*** | (2006.01) |
| ***B65D 47/18*** | (2006.01) |

(52) U.S. Cl.

CPC ..... *B65D 47/0804* (2013.01); *B65D 47/06* (2013.01); *B65D 47/18* (2013.01)

(58) Field of Classification Search

CPC ..... B65D 47/18; B65D 47/0804; B65D 47/06
USPC ..... 215/227
See application file for complete search history.

(56) References Cited

U.S. PATENT DOCUMENTS 2,663,463 A * 12/1953 White ..... B65D 41/0414 222/215
2,673,661 A * 3/1954 Barton ..... B65D 47/18 222/212
2,874,881 A * 2/1959 Stull ..... B65D 47/18 222/215
2,907,496 A * 10/1959 Palle ..... B65D 35/14 222/562
2,987,223 A * 6/1961 Armour ..... B65D 47/18 222/207
3,788,528 A * 1/1974 Ogle ..... B65D 83/0055 222/209
5,076,474 A 12/1991 Hansen
5,219,101 A * 6/1993 Matkovich ..... A61F 9/0008 210/321.64
5,246,145 A * 9/1993 Leoncavallo ..... B65D 47/0885 215/216
5,263,615 A * 11/1993 Anderson ..... B65D 1/0223 222/212

(Continued)

FOREIGN PATENT DOCUMENTS

DE 6933320 U 12/1969
DE 4117220 C1 5/1992

(Continued)

*Primary Examiner* — Ernesto A Grano
(74) *Attorney, Agent, or Firm* — Laurence A. Greenberg; Werner H. Stemer; Ralph E. Locher

(57) ABSTRACT

A dosing cap is configured for fitting on a dosing bottle and has a dosing channel which extends in a longitudinal direction and which has, at one end, an outlet opening for a liquid that is to be dosed. The dosing channel contains a first dosing portion, which tapers in the longitudinal direction to a dosing diameter, wherein the dosing diameter is in the range from 0.2 mm to 1.2 mm. Moreover, the dosing channel contains a second dosing portion, which adjoins the first dosing portion in the longitudinal direction to form a first step and which has a diameter greater than the dosing diameter.

19 Claims, 2 Drawing Sheets

(56) References Cited

U.S. PATENT DOCUMENTS 5,328,058 A * 7/1994 Leoncavallo ..... B65D 47/0885 215/216
5,358,151 A 10/1994 Strasenburgh
5,373,964 A * 12/1994 Moore ..... A61F 9/0008 222/1
5,427,275 A * 6/1995 Hansen ..... B65D 47/123 222/420
5,431,314 A 7/1995 Bonnelye et al.
5,497,910 A * 3/1996 Meadows ..... B65D 47/18 222/209
5,564,596 A * 10/1996 Meadows ..... B65D 47/18 222/145.1
5,730,322 A * 3/1998 Iba ..... B65D 47/265 222/212
5,775,546 A * 7/1998 Buehler ..... B01L 3/021 222/209
6,076,709 A * 6/2000 Wilner ..... B65D 47/18 222/212
7,063,241 B2 * 6/2006 Spada ..... A61F 9/0026 222/420
7,677,417 B2 * 3/2010 Leiner ..... B65D 47/18 222/1
8,293,299 B2 10/2012 Ragnarsson et al.
8,444,610 B2 * 5/2013 Grevin ..... A61F 9/0008 222/420
8,603,557 B2 12/2013 De Cleir et al.
8,695,850 B2 * 4/2014 Bowman ..... A61F 9/0008 222/420
9,650,188 B1 * 5/2017 Grabowski ..... B65D 51/222
9,815,598 B2 * 11/2017 Cutts ..... B65D 35/44
2004/0050881 A1 * 3/2004 Deussen ..... B65D 47/18 222/420
2006/0037972 A1 2/2006 Leiner et al.
2007/0215631 A1 * 9/2007 Bendor ..... A47K 10/42 221/63
2009/0026228 A1 1/2009 Bressler et al.
2009/0101681 A1 * 4/2009 Dato ..... B01L 3/0272 222/420
2011/0297703 A1 12/2011 Wilson et al.
2013/0119062 A1 * 5/2013 Ziegenhorn ..... B65D 43/22 220/266
2016/0272381 A1 * 9/2016 Kim ..... A45D 34/00

FOREIGN PATENT DOCUMENTS

DE 102004040099 A1 2/2006
DE 102006005608 A1 8/2007
EP 0222944 A1 5/1987
EP 0312725 A2 4/1989
EP 0594490 A1 4/1994
EP 1985547 A1 10/2008
GB 2448725 A 10/2008
JP 2002362603 A 12/2002
WO 2004069678 A1 8/2004
WO 2011031985 A2 3/2011
WO 2012063798 A1 5/2012

* cited by examiner

DOSING CAP FOR A DOSING BOTTLE

CROSS-REFERENCE TO RELATED APPLICATION

This application claims the priority, under 35 U.S.C. § 119, of European application EP 14 199 368.3, filed Dec. 19, 2014; the prior application is herewith incorporated by reference in its entirety.

BACKGROUND OF THE INVENTION

Field of the Invention

The invention relates to a dosing cap for fitting on a dosing bottle, with a dosing channel which extends in a longitudinal direction and which has, at one end, an outlet opening for a liquid that is to be dosed.

A dosing cap of this kind is known, for example, from German patent DE 41 17 220 C1.

Dosing bottles for dosing liquids of different viscosities are used in a wide variety of fields, for example in hygiene articles, in the food industry or also in the medical or pharmaceutical sector. The aim of using them is, among other things, to ensure that dosing is as precise as possible, even in the form of drops, or also to permit a closure that is as leak tight as possible.

In the food industry for example, elastic and compressible dosing bottles with a dosing cap are known, wherein a slotted dosing membrane is incorporated as an additional element into the dosing cap, through which dosing membrane the liquid to be dosed, often a viscous liquid, is forced out when pressure is applied to the dosing bottle. However, this additional membrane results in increased production work and thus leads to increased costs. A dosing bottle with a membrane integrated in a dosing cap is known, for example, from international patent disclosure WO 2011/031985 A2, corresponding to U.S. Pat. Nos. 8,293,299 and 8,603,557.

In the field of personal care products, closure caps are nowadays used that are usually composed of a main body having an outlet opening, for example for a personal care product. The main body can be closed by a lid, for which purpose a closure sleeve or a closure pin is generally inserted into the outlet opening. The whole closure cap is often configured as a one-piece plastic injection-molded component in which, therefore, the lid is integrally formed on the main body via a film hinge, for example, in the injection molding process. In addition, the lid can also be configured as a separate part, for example as a screw-on lid. Closure caps of this kind are often configured as so-called press-fit closures, which are pressed onto a corresponding bottle neck.

The outlet opening is generally formed by a cylindrical outlet which usually has a diameter of three or more millimeters, for example. The cylindrical outlet is often adjoined by a conical widening, which usually has a comparatively large cone angle, for example of 45°.

SUMMARY OF THE INVENTION

Proceeding from this, the object of the invention is to make available a dosing cap which is easy to produce and by which liquids can also be dosed in the form of drops.

According to the invention, the object is achieved by a dosing cap.

The dosing cap is configured for fitting on a dosing bottle and has a dosing channel which extends in a longitudinal direction as far as an outlet opening at one end. For this purpose, the dosing channel has a first dosing portion and a second dosing portion, which adjoin each other in the longitudinal direction. The first dosing portion tapers to a dosing diameter in the range of 0.2 mm to 1.2 mm. The dosing diameter at the same time forms the smallest diameter of the whole dosing channel. The first dosing portion with the dosing diameter is adjoined by the second dosing portion to form a step on the first dosing portion. By virtue of this configuration, therefore, the area of the dosing channel with the smallest dosing diameter, i.e. a dosing opening, is initially at a distance from the terminal outlet portion and the outlet opening. The choice of the small dosing diameter in principle permits the possibility of dosing only in the form of drops. Of particular importance is the second dosing portion of increased diameter adjoining the dosing diameter. It in fact avoids undesired escape of liquid residues from the outlet opening, for example after a dosing procedure, even when the dosing bottle provided with such a dosing cap is stored standing on its head. It is not only the small dosing diameter that is important for this but also the widened second dosing portion. Tests have shown that an unwanted drop emerging from the first dosing portion through the dosing opening is trapped and retained in the second dosing portion.

It is of particular importance here that the function of the in particular drop wise dosing, even of aqueous liquids, and moreover the function of the tight closure when not in use, are ensured alone by the design of the dosing channel. Further additional closure elements, for example a membrane, are not provided. The dosing cap is therefore free of further closure elements of this kind, in particular free of a membrane.

Moreover, the step-like configuration between the two dosing portions permits reliable and easy production of such a dosing cap as an injection molded part. The step-like transition defines a tool separation plane between two punches, which shape the two dosing portions. A step-like transition is understood as an abrupt cross-sectional widening directly in the area of the dosing opening with the dosing diameter. At the dosing opening, therefore, channel walls extend in particular in a horizontal direction as far as a diameter that is larger than the dosing diameter, which diameter is also designated below as the second inlet diameter. This design is based on the recognition that an injection molding method is suitable for the simple and cost-effective production of the dosing cap with the dosing element. However, in injection molding, dosing openings can be provided only by corresponding punches in the injection molding tool. For reasons of sufficient stability, in particular for reliable and continuous production, these punches usually have a minimum diameter of 1.5 mm, which is too large for the required dosing opening.

To permit the fine structure of the first dosing portion, and to produce the dosing cap in the context of an injection molding process, provision is made that, in order to form the dosing element, a first punch of sufficient diameter is initially still used as tool for the second dosing portion. In addition, in order to form the first dosing portion with the dosing opening of small dosing diameter at the end, a second punch of only small diameter is used, which defines the diameter of the dosing opening. In the injection molding process, the second punch, which has only slight stability, is supported on the first punch. The two punches are therefore introduced from opposite sides and between them define a partition plane. By this measure, therefore, a sufficient stability of the tool, in particular of the punches, is achieved on the one hand, while the dosing opening can be configured with a sufficiently small dosing diameter, on the other hand. Overall, a possibility is thus afforded by which a dosing cap can be produced cost-effectively, which is also reflected in the special design of the dosing cap.

Overall, with the embodiment described here, a dosing cap is made available with which dosing in the form of drops is easily possible, even in the case of aqueous liquids, or with which, in the case of the use of elastic and compressible bottles, a dosing jet can also be produced when pressure is applied to the bottle.

Provision is expediently made that the whole dosing cap is configured as a one-piece plastic injection-molded component. It is therefore not necessary to connect several parts.

The dosing diameter is preferably in a range between 0.2 and 1.2 mm, and it is in particular limited to a maximum of 0.8 mm. The choice of the specific dosing diameter depends on the field of use and in particular on the liquid that is to be dosed.

Especially for low-viscosity liquids, the dosing diameter is limited to a maximum of 0.4 mm and in particular to 0.25 mm. Passage of the liquid is reliably avoided with these small dosing diameters.

However, from the point of view of production technology, small diameters of this kind are very sensitive, since the correspondingly required punches are very fine. In order to ensure reliable production, particularly in the case of these small dosing diameters, provision is therefore made that, starting from a first inlet diameter, the first dosing portion tapers in particular conically with a cone angle, wherein the first inlet diameter is at least 1.4 mm and preferably at least 1.8 mm. The ratio of the first inlet diameter to the dosing diameter is preferably over 5, in particular over 8. The cone angle is preferably above the value for typical demolding bevels and is in particular above 8° and for example in the range of 10-15°. In this way, a frustoconical first dosing portion is created which, at its base, has a sufficient width, which corresponds to a sufficiently stable punch width. The dosing portion is of an elongate design overall.

In an expedient embodiment, for reliably avoiding unwanted escape of fractions of liquid, the second dosing portion has an intermediate area of reduced diameter. This intermediate area is in particular designed in the manner of a constriction, therefore, in the area of the intermediate area, a circumferential web, for example, is formed such that the second dosing portion as a whole has a constriction in the shape of an annular groove. In the area of this constriction, the diameter of the second dosing portion tapers by 10% to 20% for example.

The intermediate area of reduced diameter is expediently adjoined by a second and in particular cylindrical intermediate portion. The intermediate area and the intermediate portion of the second dosing portion are formed at the end, in particular in the final quarter of the second dosing portion.

The intermediate area has a reduced diameter of at most 1.0 mm to 1.5 mm and is in particular approximately 1.2 mm. However, the reduced diameter is above the dosing diameter. The second dosing portion itself preferably also has a conical shape like the first dosing portion, with the difference that it widens conically in the longitudinal direction, i.e. in the direction of the outlet opening.

Therefore, the first dosing portion and the second dosing portion are preferably both more or less frustoconical in shape. They have a cone angle in the range between 1.5° and 5°. A cone angle is understood here as the angle at which, viewed in longitudinal section, a respective boundary of the respective dosing portion is inclined with respect to a central longitudinal axis and thus with respect to the longitudinal direction.

In an expedient embodiment, at least one of the dosing portions, in particular the first dosing portion, is elongate. Preferably both dosing portions are elongate. They thus have a length which is a multiple of, in particular more than three times or four times, the respective minimal diameter of the respective dosing portion. Overall, this creates a comparatively long path length, which in particular reliably prevents undesired escape of liquid.

The outlet opening itself has an outlet diameter which is usually greater than or equal to 1.5 mm and is in particular in the range of 1.5 mm to 2.5 mm.

The outlet opening is part of an outlet portion of the dosing channel, wherein the outlet portion in turn has a greater diameter than the second dosing portion. In particular, the outlet portion adjoins the second dosing portion to form a second step.

Where a particular portion of the dosing channel is described as having a greater diameter than a preceding portion, this is understood to mean that an increased diameter is present in the transition area between the two portions. However, by virtue of the conical design of the two dosing portions, it is not absolutely essential that the greatest diameter, for example of the first dosing portion, is greater than the smallest diameter of the second dosing portion.

For drops to be dosed with the greatest possible precision, the outlet portion preferably terminates with a sharp edge at the outlet opening. This is understood to mean in particular that there is no conical widening present in the area of the outlet opening. In this way, a kind of separating edge is therefore formed.

In a preferred embodiment, the dosing cap contains a bottle neck collar, which is formed in the manner of a skirt and which surrounds an interior. A dosing pin, which has the dosing channel, extends into this interior. The dosing pin is expediently part of a dosing element which extends as a whole through a front lid base, such that the dosing element, outside on the outer face of the lid base, has a dosing tip in the manner of a dome-like elevation. The bottle neck collar is in particular an inner skirt which is usually additionally surrounded by an outer bottle neck collar, which is turn is surrounded by an outer wall. The bottle neck collar is designed here as an annular collar and the annular collar defines a dosing space for the liquid to be dosed. When the dosing cap is fitted on the dosing bottle, the bottle neck collar thus usually engages in a bottle neck of the dosing bottle with an exact fit, i.e. it preferably bears flush and sealingly on a cylindrical (inner) face of the bottle neck. This ensures that the liquid to be dosed emerges exclusively through the dosing opening. The collar preferably has a conical sealing bevel on the end side in this case. In the longitudinal direction, the collar extends, for example, over 8 mm to 20 mm and typically over approximately 10 mm to 15 mm.

In a preferred development for making assembly as easy as possible, the dosing cap is configured as a press-fit cap. The dosing cap is therefore simply pressed onto the bottle neck. It does not have to be screwed on, etc. Alternatively, the principle described here as regards the design of the dosing element can also be transferred in theory to screw-type closures of all kinds.

In an expedient development, the dosing cap additionally has a closure lid which, in the closed state, sealingly closes the outlet opening. This additionally ensures that no liquid escapes from the bottle, for example during transport or in the event of the dosing bottle tipping over.

For leak-tight closure of the outlet opening, the closure lid, according to a first embodiment variant, has a closure pin which, in the closed state, i.e. with the closure lid closed, lies sealingly in the outlet portion. The closure pin extends at most as far as the second dosing portion. In particular, provision can also be made here that is supported on the second step between the second dosing portion and the outlet portion, and, in this way, a sealing surface is formed. Alternatively or in addition to this, the circumference of the closure pin bears sealingly on the surrounding wall of the outlet portion. To permit sealing on the step, the length of the closure pin expediently has a length corresponding to the length of the outlet portion. To permit circumferential sealing, the closure pin has a diameter corresponding to the diameter of the outlet portion. Generally, the closure pin expediently has a certain oversize such that, in the closed state, it is pressed in and forms a tight fit. The closure pin is generally adapted to the contour of the outlet portion. If necessary, it can also have slight protuberances in some areas of its circumferential face, for example, in order there to form what is in effect an annular seal.

For leak tight closure, the closure lid alternatively or additionally has an integrally formed sealing sleeve, which is pushed sealingly over an end portion of the dosing channel. This end portion is in particular configured as a dome-like dosing tip. In a preferred embodiment, the dosing tip in this case has, in the area of the outlet opening, a convexly curved sealing surface via which the sealing sleeve is pushed sealingly when the closure lid is fitted.

The closure lid is configured overall as a closure lid that is preferably pivotably articulated via a film hinge, and it is therefore a constituent part of the one-piece injection-molded part forming the dosing cap. The whole closure cap containing the dosing cap and closure lid is therefore a monolithic, one-piece component that is able to be produced cost-effectively.

Other features which are considered as characteristic for the invention are set forth in the appended claims.

Although the invention is illustrated and described herein as embodied in a dosing cap for a dosing bottle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
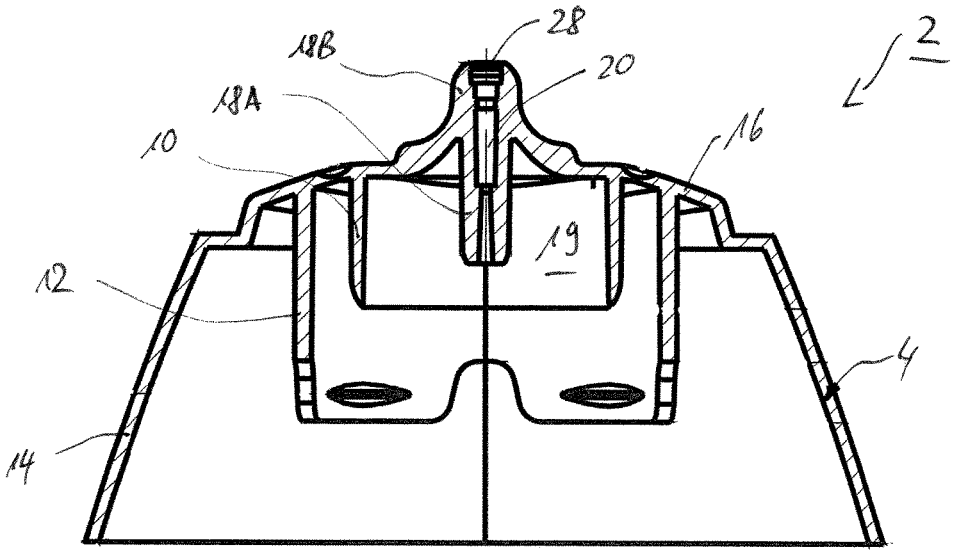
FIG. 1 is a diagrammatic, sectional view through a dosing cap taken along the section plane I-I shown in FIG. 4.
Figure 2:
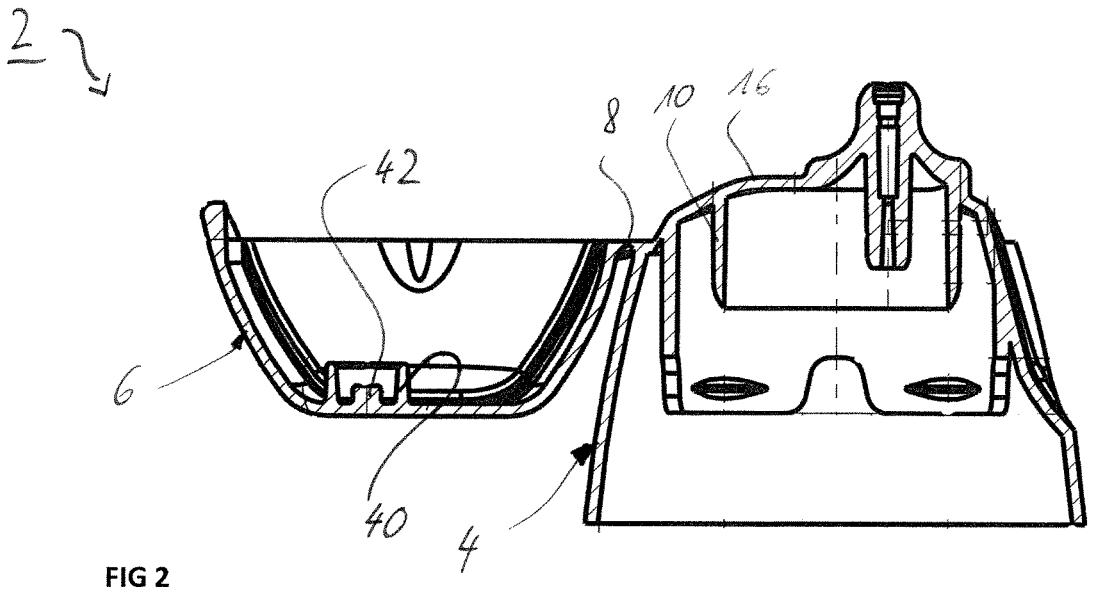
FIG. 2 is a sectional view taken along the section line II-II shown in FIG. 4.

Parts having the same function are each provided with the same reference sign in the figures.

Referring now to the figures of the drawings in detail and first, particularly to FIGS. 1-4 thereof, there is shown a dosing cap 2 which has a main body 4 and a closure lid 6 which, together with the main body 4, forms a common, monolithic injection-molded part. The closure lid 6 here is pivotably connected to the main body 4 via a film hinge 8. In the illustrative embodiment, the dosing cap 2 is moreover configured as a press-fit cap, which is mounted on a dosing bottle (not shown here) by being simply pressed onto a bottle neck. The dosing bottle is, for example, an elastic dosing bottle made of plastic and is provided, for example, for holding liquid foods, liquid hygiene articles, liquid pharmaceutical products or medicaments. The liquid contained in the bottle can be dosed by way of the dosing cap 2. Here, liquid is understood both as an aqueous composition and also as a viscous composition.

For fitting it on the bottle neck of the dosing bottle, the main body 4 has an inner, annular bottle neck collar 10 and an outer, annular bottle neck collar 12 between which, in the fitted state, the bottle neck of the dosing bottle is received as sealingly as possible. In addition, the main body 4 also has a circumferential outer jacket 14. The latter merges, at the front, into a substantially horizontally extending end base 16. The end base 16 has passing through it a dosing element, which forms a dosing pin 18A lying to the inside and a dosing tip 18B lying to the outside. The dosing tip 18B rises in a dome shape from the end base 16, whereas the dosing pin 18A extends into an interior 19 formed by the inner bottle neck collar 10. A dosing channel 20 extending in a longitudinal direction Z is formed in the dosing element.

Figure 3:
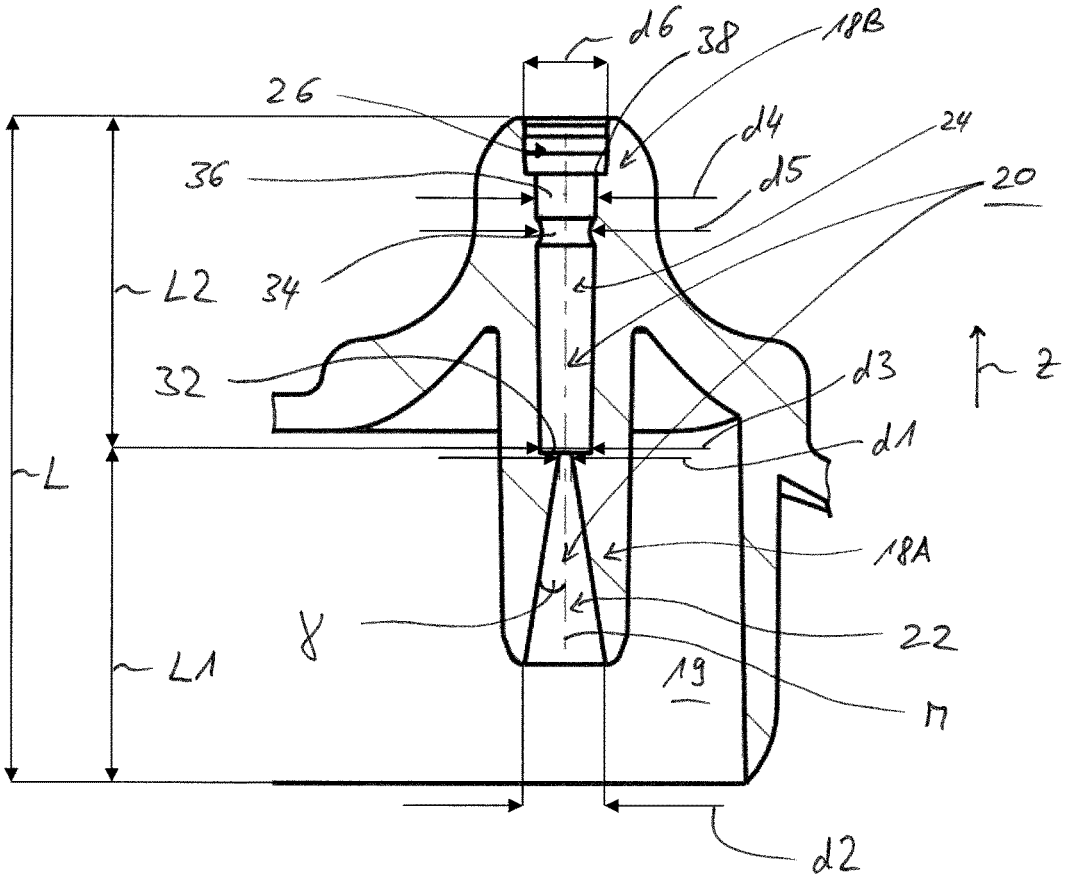
FIG. 3 is an enlarged detail of a section through the closure cap as per FIG. 1.
Figure 4:
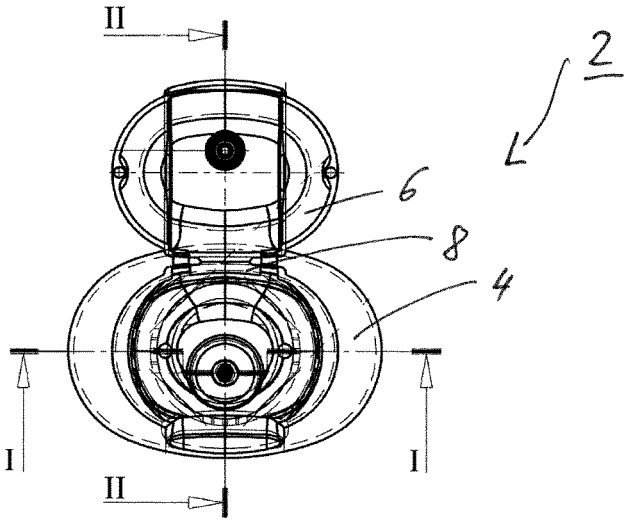
FIG. 4 is a plan view of the dosing cap with main body and closure lid, when the closure lid is opened.

The dosing channel 20 itself contains several portions, as can be seen in particular from FIG. 3. These are a first dosing portion 22, a second dosing portion 24, and a front outlet portion 26, which has a front outlet opening 28 of the dosing channel 20. The dosing channel 20 preferably has no further portions.

The individual portions 22, 24, 26 are arranged concentrically to each other and thus extend along a common central axis M. The dosing channel 20 has a circular cross-sectional area along its entire length. The first dosing portion 22 and the second dosing portion 24 are each preferably configured as slightly conical channels with a cone angle $\gamma$. The latter is preferably between 1° and below 5° and, in the illustrative embodiment, in particular 1.5°. The cone angle $\gamma$ defines the inclination of the wall of the dosing portion 22, 24 with respect to the central axis M. Unlike the first dosing portion 22, the second dosing portion 24 does not extend conically along its entire length. Instead, in addition to the conical sub region, it also has at its upper end an intermediate area 34, which is configured in the manner of a constriction, and what is in particular a cylindrical intermediate portion 36.

Compared to the second dosing portion, a much greater cone angle $\gamma$ of approximately 10° is preferably chosen for the first dosing portion 22, such that a much steeper truncated cone is formed than in the dosing portion 22. The cone angle of the second dosing portion 24 is in particular in the range between 1° and below 5°, being in particular approximately 1.5°.

The second dosing portion 24 adjoins the end of the conical area (FIG. 3) to form a first step 32. The second dosing portion 24 has, in its end area, in turn firstly the intermediate area 34 and, following the latter, the second and in particular cylindrical intermediate portion 36. The latter is in turn adjoined by the outer portion 26 to form a second step 38.

The narrowest point of the dosing channel 20 is formed at the end of the first dosing portion 22 at the first step 32. There, the dosing channel 20 has a dosing diameter d1 and thus forms a dosing opening. The dosing diameter d1 is preferably in the range of between 0.2 mm, in particular between 0.4 mm and 1.2 mm. In the illustrative embodiment in FIG. 1, it is preferably 0.6 mm. In the preferred illustrative embodiment in FIG. 3, it is in the range between 0.2 mm and 0.4 mm and is in particular 0.25 mm. From a first inlet diameter d2, the first dosing portion 22 tapers continuously to the dosing diameter d1. The first inlet diameter d2 is, for example, in the range between 0.7 mm and 1.2 mm and is in particular 0.9 mm. It tapers in particular by approximately the factor 1.5 to 0.6 mm of the dosing diameter d1.

In the preferred variant as per FIG. 3, the first inlet diameter d2 is considerably greater and is in particular approximately 2.0 mm. It therefore tapers by approximately the factor 8 to 0.25 mm of the dosing diameter d1. This embodiment variant is also suitable for thinner dosing liquids and at the same time ensures reliable production of the closure cap 2 in an injection molding method.

The second dosing portion 24 finally widens conically from a second inlet diameter d3 at the first step 32 to an end diameter d4 at the second step 38. The second inlet diameter d3 is considerably greater than the dosing diameter d1 and is, for example, approximately twice the dosing diameter d1. In the illustrative embodiment, the second inlet diameter d3 is approximately 1.2 mm. The second dosing portion 24 then widens conically to approximately 1.3 mm to 1.8 mm and, in the illustrative embodiment, up to 1.5 mm.

In the intermediate area 34, the dosing channel 20 has a constriction which, in the illustrative embodiment, is formed by a concave annular groove in the channel 20. In this area, the second dosing portion 24 has a reduced diameter d5 which, in the illustrative embodiment, is in the range between 1.0 mm and 1.3 mm and is preferably 1.2 mm.

Finally, the outlet portion 26 has, at one end, the outlet opening 28 with an outlet diameter d6 which is in the range between 1.5 mm and 2.5 mm and, in the illustrative embodiment, is approximately 2.0 mm. The outlet portion 26 has an approximately cylindrical design, although it can also be slightly conical like the other portions 22, 24.

In addition to the intermediate area 34, it is in principle possible for further intermediate areas of reduced diameters to be formed, for example also in the outlet portion 26, and/or a further intermediate area 34 in the second dosing portion 24.

As can be seen in particular from FIG. 3, the two dosing portions 22, 24 are very elongate channel portions. The first dosing portion 22 has a first length L1, and the second dosing portion 24 has a second length L2. These lengths L1, L2 are each a multiple of the smallest diameter of the respective portion 22, 24, i.e. a multiple of the dosing diameter d1 and of the second inlet diameter d3, respectively. In the illustrative embodiment, the lengths L1, L2 are each over 5 times this smallest respective portion diameter. With very small diameters, in particular with small dosing diameters d1, for example as per FIG. 3, the length L1 is also over 10 times and in particular also over 15 times the smallest portion diameter. The lengths L1, L2 are typically in the range from 3 mm to 7 mm and in particular in the range from 4 mm to 6 mm.

The individual sub regions of the respective dosing portions 22, 24, namely the two intermediate portions 30, 36 (if present) and the intermediate area 34, are by contrast not configured as elongate portions, that is to say their length in the longitudinal direction Z is smaller than their diameter or corresponds at most substantially to their diameter.

The same also applies to the outlet portion 26, of which the length in the longitudinal direction Z preferably corresponds at most approximately to the outlet diameter d6.

The outlet portion 26 is sharp-edged in the area of the outlet opening 28, that is to say it has a kind of separation edge at the end. This promotes the defined formation of a drop.

The whole dosing channel 20 has a total length L which, in the illustrative embodiment, is approximately 10 mm to 15 mm. The two dosing portions 22, 24 together form approximately 70 to 90% of the total length L.

In order to ensure, even under unfavorable conditions, that the outlet opening 28 is closed in a permanently sealed manner when the closure lid 6 is closed, for example during transport, the closure lid 6 in the illustrative embodiment has two sealing elements. These are, on the one hand, a sealing sleeve 40 and, on the other hand, a closure pin 42, which is surrounded annularly by the sealing sleeve 40 (see FIG. 2). The sealing sleeve 40 has an internal diameter which is adapted to an external diameter of the dosing tip 18B. The internal diameter preferably has a slight undersize, and the sealing sleeve 40 preferably has a slightly conical design such that, when it is fitted onto the dosing tip 18B, it nestles annularly and sealingly against the circumferential wall of the latter.

The closure pin 42 has an external diameter which is adapted to the outlet diameter d6. It preferably has a slight oversize in relation thereto such that the closure pin 42 bears with its circumferential surface sealingly on the circumferential wall of the outlet portion 26. The closure pin 42 has an axial length which is less than or equal to the length of the outlet portion 26.

By virtue of the overall design of the dosing channel 20 as described here, liquids are able to be dosed with precision, even in drops. At the same time, undesired running out of the liquid is avoided. Reliable production of the dosing cap 2 is achieved. The dosing cap 2 is configured as a one-piece plastic injection-molded component without supplementary closure elements.

Despite the small dosing diameter d1 of only 0.6 mm (FIG. 1) or of only 0.25 mm (FIG. 3), the shape of the dosing channel 20 as specifically described here can be reliably produced with the aid of an injection molding tool (not shown here).

For production, an injection mold is used which has an upper mold and a lower mold, between which a cavity is formed into which the injection molding material is injected to form the dosing cap 2.

On one mold, a first punch is formed which shapes the first dosing portion 22. The other mold has a second punch, which is configured to shape the second dosing portion 24 and the outlet portion 26. The two punches bear on each other at a separation plane. The first punch with the only small dosing diameter is supported on the second punch, as a result of which a sufficiently high degree of stability is achieved for the injection molding. Furthermore, the punches can be configured in such a way that they engage slightly in each other with a form fit, such that the first punch is held with a form fit on the second punch 44.

The following is a summary list of reference numerals and the corresponding structure used in the above description of the invention:

2 dosing cap
4 main body
6 closure lid

8 film hinge
10 inner bottle neck collar
12 outer bottle neck collar
14 outer jacket
16 lid base
18A dosing pin
18B dosing tip
19 interior
20 dosing element
22 first dosing portion
24 second dosing portion
26 outlet portion
28 outlet opening
M central axis
32 first step
34 intermediate area
36 second intermediate portion
38 second step
40 sealing sleeve
42 closure pin
d1 dosing diameter
d2 first inlet diameter
d3 second inlet diameter
d4 end diameter
d5 reduced diameter
d6 outlet diameter
L1 first length
L2 second length
L3 total length
γ cone angle

The invention claimed is:

1. A dosing cap for fitting on a dosing bottle, the dosing cap comprising:

a dosing channel extending in a longitudinal direction and having an end with an outlet opening formed therein for a liquid that is to be dosed, said dosing channel having a first dosing portion defined by a conical side wall tapering continuously in the longitudinal direction to a dosing opening having a dosing diameter, the dosing diameter being in a range from 0.2 mm to 1.2 mm, and said dosing channel having a second dosing portion adjoining said first dosing portion in the longitudinal direction on a side closest to said outlet opening to form a first step and having a diameter being greater than the dosing diameter, said first step being an abrupt cross-section widening from the dosing diameter to the diameter of said second dosing portion;

a bottle neck collar defining and surrounding an interior of the dosing cap; and a dosing pin carrying said dosing channel and extending into said interior, said interior forming a dosing space for the liquid.

2. The dosing cap according to claim 1, wherein said dosing diameter is at most 0.8 mm.

3. The dosing cap according to claim 2, wherein said dosing diameter is at most 0.25 mm.

4. The dosing cap according to claim 1, wherein said first dosing portion has a first inlet diameter and starting from said first inlet diameter, said first dosing portion tapers in a direction of said dosing diameter, wherein said first inlet diameter is at least 1.4 mm.

5. The dosing cap according to claim 4, wherein said first dosing portion tapers conically in a continuous manner from said first inlet diameter to said dosing diameter.

6. The dosing cap according to claim 1, wherein said second dosing portion has an intermediate area of reduced diameter.

7. The dosing cap according to claim 6, wherein said second dosing portion has an intermediate portion disposed at an end of said second dosing portion and is disposed downstream from said intermediate area.

8. The dosing cap according to claim 6, wherein said intermediate area has a reduced diameter of at most 1.0 mm to 1.5 mm.

9. The dosing cap according to claim 1, wherein said first dosing portion and said second dosing portion are elongate and each have a length which is a multiple of a minimal diameter of said respective first and second dosing portions.

10. The dosing cap according to claim 1, wherein said outlet opening has an outlet diameter in a range of greater than or equal to 1.5 mm.

11. The dosing cap according to claim 1, wherein said dosing channel has an outlet portion which is disposed downstream from said second dosing portion in the longitudinal direction, said outlet portion has said outlet opening, and said outlet portion has a diameter greater than said second dosing portion.

12. The dosing cap according to claim 11, wherein said outlet portion adjoins said second dosing portion to form a second step.

13. The dosing cap according to claim 11, wherein said outlet portion terminates with a sharp edge at said outlet opening.

14. The dosing cap according to claim 1, wherein the dosing cap is a press-fit cap.

15. The dosing cap according to claim 1, further comprising:

a dosing tip; and a closure lid which, in a closed state, sealingly closes said outlet opening and for this purpose said closure lid has at least one of a closure pin or a sealing sleeve, wherein said closure pin in the closed state lies sealingly in said outlet portion, and said sealing sleeve, in the closed state, sealingly encloses said dosing tip having said dosing channel.

16. The dosing cap according to claim 1, wherein said first dosing portion has a first inlet diameter and starting from said first inlet diameter, said first dosing portion tapers in a direction of said dosing diameter, conically with a cone angle, wherein said first inlet diameter is at least 1.8 mm.

17. The dosing cap according to claim 1, wherein said first dosing portion and said second dosing portion are elongate and each have a length which is at least three times a minimal diameter of said respective first and second dosing portions.

18. The dosing cap according to claim 1, wherein said outlet opening has an outlet diameter in a range of 1.5 mm-2.5 mm.

19. A dosing cap for fitting on a dosing bottle, the dosing cap comprising:

a bottle neck collar for fitting on a bottle neck of the dosing bottle, said bottle neck collar surrounding an interior of the dosing cap;

a dosing tip; and a dosing pin extending into the interior, said dosing pin being adjoined in a longitudinal direction by said dosing tip, said dosing pin and said dosing tip together define a dosing channel extending in the longitudinal direction and said dosing channel having, at one end, an outlet opening formed therein for a liquid that is to be dosed, said dosing channel having a first conical dosing portion tapering continuously in the longitudinal direction as far as an opening with a dosing diameter, said dosing diameter is in a range from 0.2 mm to 1.2 mm, said dosing channel having a second dosing portion adjoining said first conical dosing portion in the longitudinal direction on a side closest to said outlet opening to form a first step and having a diameter greater than the dosing diameter, said second dosing portion having, at a distance from the first step, an intermediate area of reduced diameter, said second dosing portion having a second intermediate portion which is disposed at an end downstream from said intermediate area and having a diameter greater than said intermediate area, said dosing channel having an outlet portion adjoining said second dosing portion in the longitudinal direction to form a second step, said outlet portion having said outlet opening and having a diameter greater than said second dosing portion.

* * * * *